US007485164B2

(12) United States Patent
Jeong et al.

(10) Patent No.: US 7,485,164 B2
(45) Date of Patent: Feb. 3, 2009

(54) DUST COLLECTION UNIT FOR VACUUM CLEANER

(75) Inventors: Hoi Kil Jeong, Changwon-si (KR); Man Tae Hwang, Changwon-si (KR); Young Ho Kim, Changwon-si (KR); Jung Bae Hwang, Daegu (KR); Min Park, Busan (KR)

(73) Assignee: LG Electronics, Inc., Seoul (KR)

( * ) Notice: Subject to any disclaimer, the term of this patent is extended or adjusted under 35 U.S.C. 154(b) by 559 days.

(21) Appl. No.: 11/232,875

(22) Filed: Sep. 23, 2005

(65) Prior Publication Data

US 2006/0137308 A1 Jun. 29, 2006

(30) Foreign Application Priority Data

Dec. 27, 2004 (KR) ..... 10-2004-0113375
Dec. 27, 2004 (KR) ..... 10-2004-0113376

(51) Int. Cl.
*B01D 45/12* (2006.01)

(52) U.S. Cl. ..... 55/337; 55/343; 55/346; 55/429; 55/DIG. 3

(58) Field of Classification Search ..... 55/343, 55/346, 337, 429, DIG. 3
See application file for complete search history.

(56) References Cited

U.S. PATENT DOCUMENTS

| | | | | |
|---|---|---|---|---|
| 3,320,727 | A | 5/1967 | Farley et al. | |
| 6,502,278 | B2 | 1/2003 | Oh et al. | |
| 6,810,558 | B2 | 11/2004 | Lee | |
| 7,128,770 | B2 * | 10/2006 | Oh et al. | 55/343 |
| 2002/0194993 | A1 | 12/2002 | Gen | |

FOREIGN PATENT DOCUMENTS

| | | |
|---|---|---|
| GB | 2 399 780 A | 9/2004 |
| SU | 2204312 C2 | 5/2003 |
| SU | 2226354 C2 | 4/2004 |

* cited by examiner

*Primary Examiner*—Robert A Hopkins
(74) *Attorney, Agent, or Firm*—McKenna Long & Aldridge LLP

(57) ABSTRACT

A dust collection unit for a vacuum cleaner includes a collection body having a plurality of filtering chambers different from each in a volume and a plurality of storing chambers storing foreign objects filtered in the filtering chambers, a bottom seal member defining a bottom of the collection body, and an exhaust member guiding airflow in the filtering chambers. The exhaust member contacts tops of the filtering chambers as well as an outer circumference of the collection body.

19 Claims, 8 Drawing Sheets

DUST COLLECTION UNIT FOR VACUUM CLEANER

BACKGROUND OF THE INVENTION

1. Field of the Invention

The present invention relates to a dust collection unit for a vacuum cleaner, and more particularly, to a dust collection unit for a vacuum cleaner, which can be easily assembled and improved in strength and dust collection efficiency by preventing settled foreign objects from leaking.

2. Description of the Related Art

A vacuum cleaner is used to clean a room or other spaces by sucking air containing foreign objects and filtering the foreign object using vacuum pressure generated therein. In order to filter the foreign objects contained in the sucked air, a dust collection unit with a filtering unit is provided in the vacuum cleaner.

The filtering unit is classified into a porous filter formed of porous material and a cyclone type filter. The porous filter formed of porous material is designed to filter the foreign objects contained in air while the air passes through the filter. The cyclone type filter is designed to filter the foreign objects using cyclone airflow. In order to reuse the porous filter, a user cleans the filter to remove the foreign objects clogged in the filter. It is very inconvenient to clean the filter. Furthermore, when a large amount of the foreign objects are clogged, the porous filter cannot be reused. Since the cyclone type filter is designed to remove the foreign objects from the air by a rotational air current generated by cyclone airflow, the clogging of the foreign objects in the filter is not incurred. Due to this reason, in recent years, cyclone type filter has been widely used.

In recent years, a multi-cyclone type dust collection unit, in which the cyclone unit is provided in plurality to generate a plurality of cyclone airflows so that the foreign objects contained in the air can be filtered by only the cyclone airflows, has been developed. The multi-cyclone airflows improve the foreign object removal efficiency. In addition, since there is no need to additionally provide the porous filter in the dust collection unit, the clogging problem is not incurred.

However, the multi-cyclone type dust collection unit is designed to remove the foreign objects using only the cyclone airflows, the foreign object removable efficiency is still insufficient. Therefore, there is a pressing need to improve the foreign objects removal efficiency in the multi-cyclone type dust collection unit.

In addition, since the multi-cyclone dust collection unit includes a plurality of parts formed of rigid plastic resin, there may be gaps between the parts. The air may leak through the gaps, thereby deteriorating the dust collection efficiency.

Furthermore, it is time-consuming to assemble the plurality of parts. The assembled dust collection unit may be easily broken when the strength thereof is lowered.

SUMMARY OF THE INVENTION

Accordingly, the present invention is directed to a dust collection unit for a vacuum cleaner that substantially obviates one or more problems due to limitations and disadvantages of the related art.

An object of the present invention is to provide a dust collection unit for a vacuum cleaner, which can be easily assembled and improved in strength and endurance.

Another object of the present invention is to provide a dust collection unit for a vacuum cleaner, which can improve the dust collection efficiency by preventing air and foreign objects from leaking.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dust collection unit for a vacuum cleaner, including: a collection body having a first central filtering chamber for filtering foreign objects contained in air using a cyclone airflow and a plurality of second filtering chamber formed along an outer circumference of the first cylindrical filtering chamber to receive the air passed through the first cylindrical filtering chamber; an exhaust member having an upper end contacting the second filtering chambers and an inner circumference contacting an outer circumference of the collection body; and a seal member provided on a contacting surface between the second filtering chambers and the exhaust member.

In another aspect of the present invention, there is provided a dust collection unit for an air cleaner, including: a collection body provided with a plurality of foreign object filtering chambers and foreign object storing chambers; an exhaust member provided on an upper portion of the collection body to guide the flow of the air exhausted from the foreign object filtering chambers; and a guide rib formed on an outer surface of the collection body to contact an inner circumference of the exhaust member.

In a still another aspect of the present invention, there is provided a dust collection unit for a vacuum cleaner, including: a collection body provided with a plurality of foreign object filtering chambers and foreign object storing chambers; a filter disposed in one of the foreign object filtering chambers, the filter being formed of rigid plastic material; an exhaust member provided above the collection body to guide the air exhausted from one of the foreign object filtering chambers; a seal member inserted in a contacting surface between the exhaust member and the collection body; a gap forming member provided above the exhaust member to provide a gap through which the air exhausted from the collection body is guided; and a bottom seal member defining a bottom of the collection body.

According to the present invention, the inventive dust collection unit can be conveniently assembled and improved in strength, thereby providing the convenience in use to a user and increasing the service lift thereof.

In addition, since the air passage of the dust collection unit does not leak the foreign objects, the foreign object removal efficiency can be improved.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
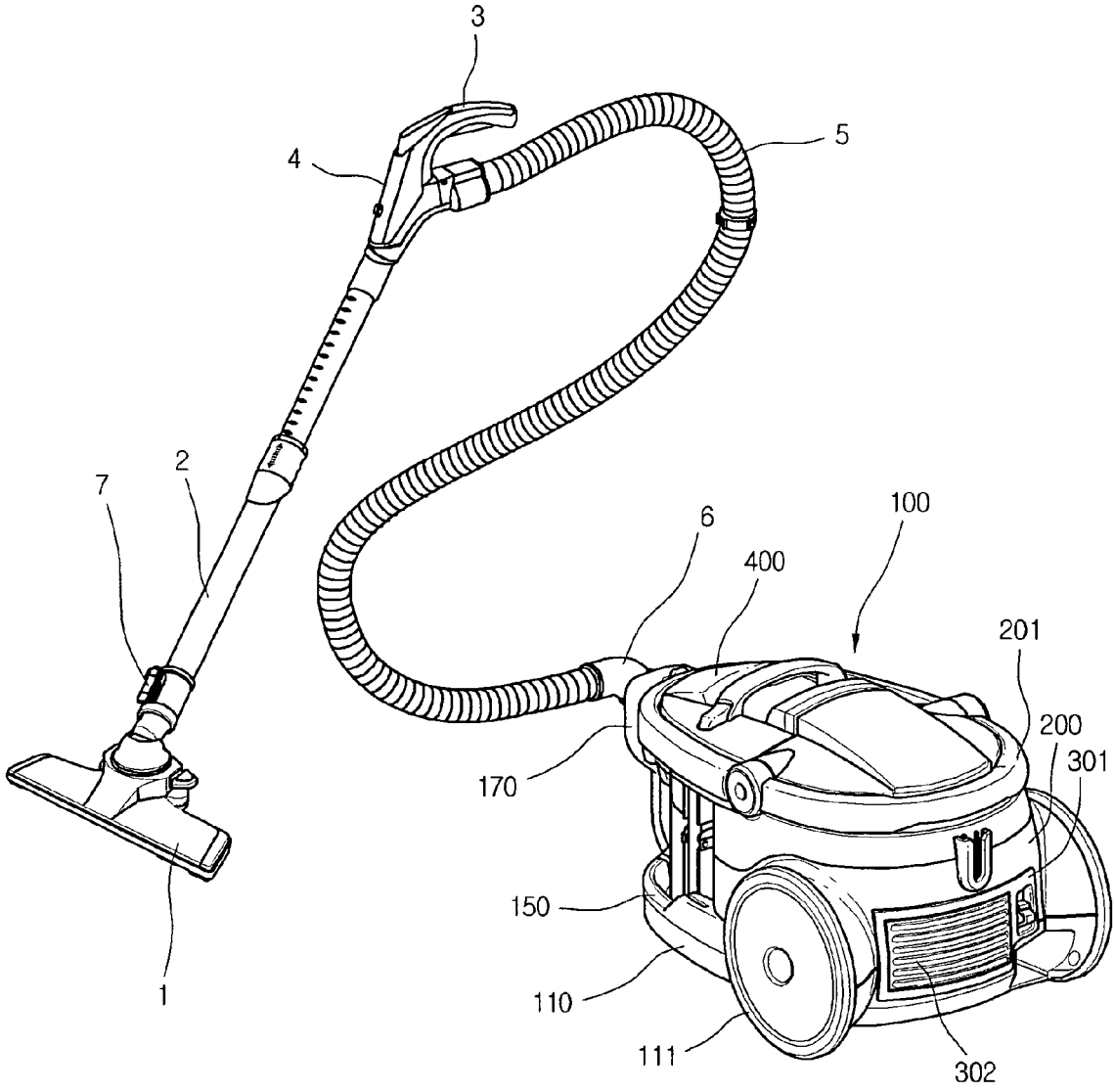
FIG. 1 is a perspective view of a vacuum cleaner where a dust collection unit of the present invention can be employed.

FIG. 1 shows a vacuum cleaner to which a dust collection unit according to the present invention can be applied.

Referring to FIG. 1, a vacuum cleaner includes a main body 100 and a suction assembly connected to a suction portion through which outer air is sucked into the main body 100. Disposed in the main body 100 are a motor (not shown), a suction fan (not shown), and a dust collection unit (not shown) Therefore, the sucked air is exhausted out of the main body 100 after foreign objects contained in the sucked air are filtered.

The suction assembly is provided to suck the air containing the foreign objects when sucking force is generated in the main body 100. That is, the suction assembly includes a sucking nozzle body 1 for sucking the air containing the foreign objects using a powerful airflow, an expandable tube 2 extending from the sucking nozzle body 1 and expandable and contractible by a user, an operation handle 3 provided on a distal end of the expandable tube 2, a manipulation unit 4 provided on a front portion of the operation handle 3, a flexible tube 5 extending from the operation handle 2, a connector 6 connecting a distal end of the flexible tube 5 to the main body 100, a pipe rest 7 on which the expandable pipe 2 can be supported and suspended when the vacuum cleaner is not used.

The connector 6 functions as a connection terminal transmitting a manipulation signal inputted by the user through the manipulation unit 4 to the main body 100 as well as a passage through which the sucked air is introduced into the main body 100. That is, a plurality of electric connection terminals are provided on a proximal end of the connector 6. However, the electric connection terminals are required only when the manipulation unit 4 is provided on the suction assembly. That is, when the manipulation unit 4 is provided on the main body 100, the electric connection terminals are not provided on the connector 6. In this case, the connector 6 may simply function as an air introducing passage.

The air introduced into the main body 100 through the suction assembly is exhausted out of the main body 100 after the foreign objects contained in the introduced air are filtered.

The main body 100 of the vacuum cleaner will be described in more detail hereinafter with reference to FIGS. 1 and 2.

Figure 2:
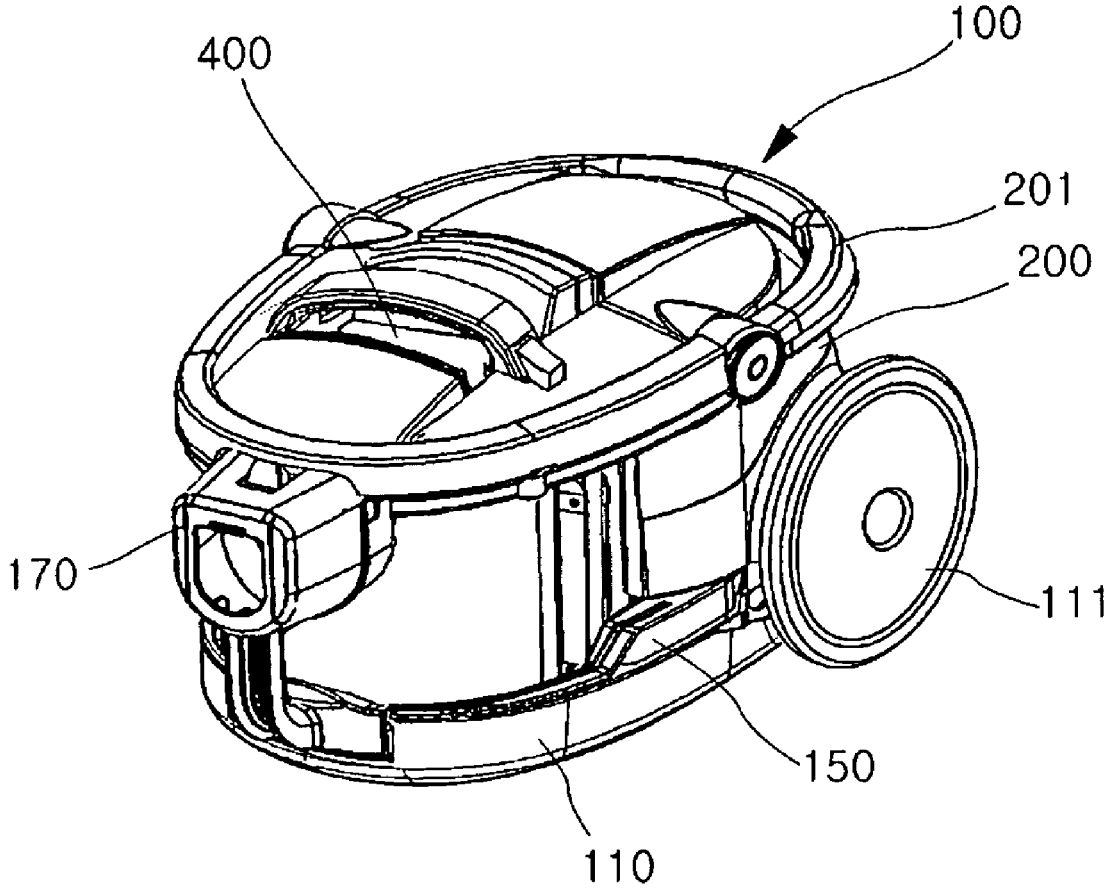
FIG. 2 is a front perspective of a vacuum cleaner depicted in FIG. 1.

FIG. 2 shows the main body of the vacuum cleaner.

Referring to FIGS. 1 and 2, the main body 100 includes a first base 110 defining a lower portion of the main body 100, a second base 150 disposed on the first base 110, a cover 200 disposed on the second base 150, wheels 111 provided on both rear-side portions of the cover 200 to make it easy to move the main body 100, and a front support 70 for supportably fixing the cover 200 and the first and second bases 110 and 150.

The connector 6 is connected to the front support 170 to allow the outer air to be introduced into the main body 100. The support 170 is designed to support the cover 200 and the first and second bases 110 and 150, thereby securely supporting the front portion of the main body 100.

The second base 150 is provided right above the first base 110 to improve the ornament of the main body and enhance the rigidity of the lower portion of the main body.

An exhaust cover 301 provided with a plurality of exhaust holes 302 is provided on a rear portion of the cover 200 to exhaust clean air. A carrying handle 201 is pivotally provided on a top surface of the cover 200. When a user intends to carry the main body 100, the user pivots the carrying handle 201 in a vertical position and conveniently carries the main body 100 with his/her hand grasping the carrying handle 201.

A dust collection unit 400 is disposed in the main body in rear of the front support 170 and a cyclone member (not shown) is received in the dust collection unit to generate cyclone airflows and filter the foreign object contained in the air.

Figure 3:
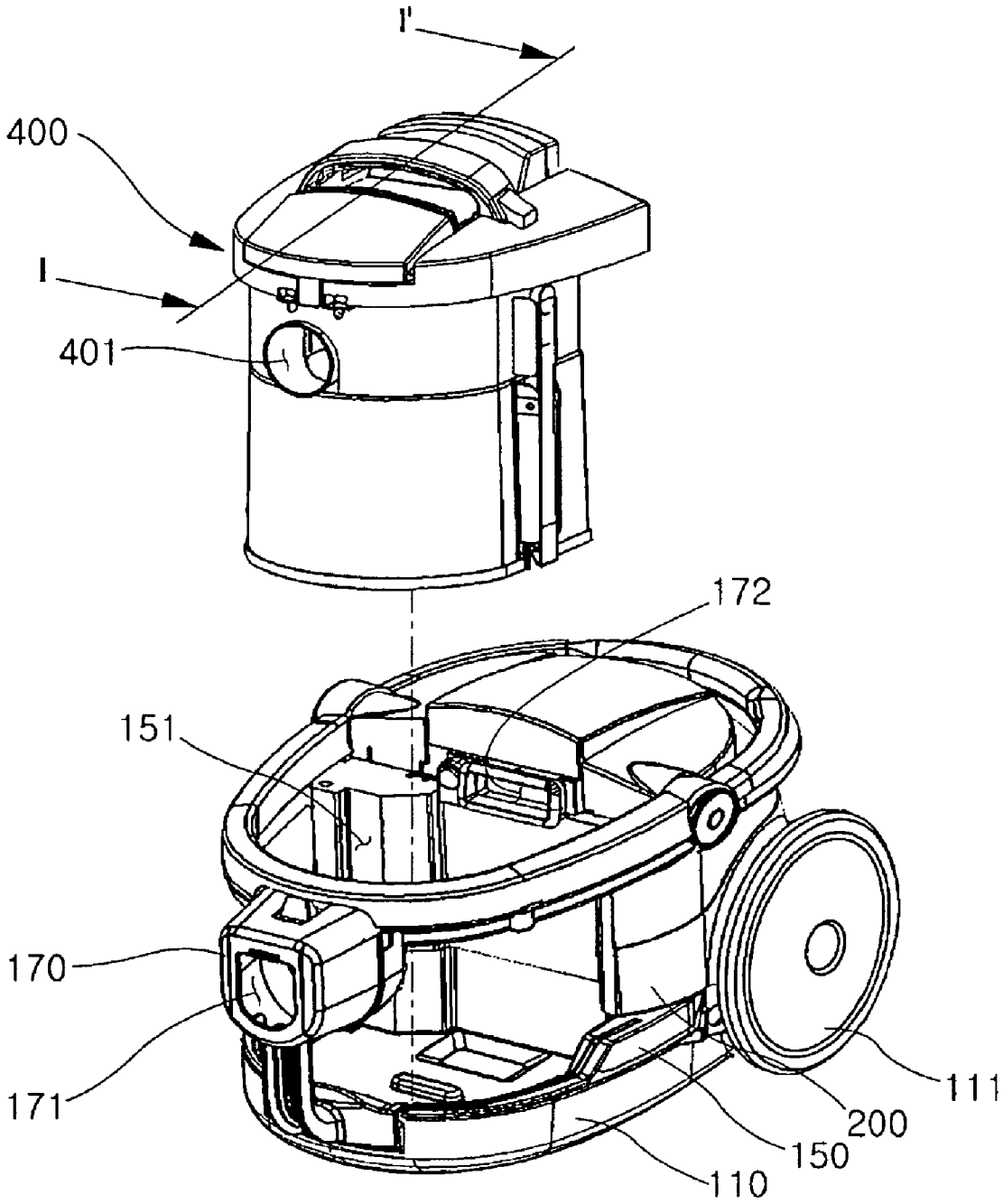
FIG. 3 is a perspective view illustrating a vacuum cleaner main body and a dust collection unit according to an embodiment of the present invention, which is separated from the vacuum cleaner main body.

As shown in FIG. 3, the dust collection unit 400 is vertically installed in and separated from a receiving chamber 151 defined in the main body 100. That is, the dust collection unit 400 may be installed in the receiving chamber 151 by being pushed downward and separated from the receiving chamber 151 by being pulled upward.

The front support 170 is provided with a first air intake hole 171 and the dust collection unit 400 is provided with a second air intake hole 401 corresponding to the first air intake hole 171. The dust collection nit 400 is further provided with an exhaust hole (not shown) opposite to the second air intake hole 401. The exhaust hole is aligned with a third air intake hole 172 formed toward the motor so that the air cleaned by passing through the collection unit 400 is exhausted toward the motor side.

Particularly, the third air intake hole 172 is formed in a rectangular shape lengthwise in a horizontal direction so as to reduce the size of the main body 100 and allow the air to effectively flow.

Figure 4:
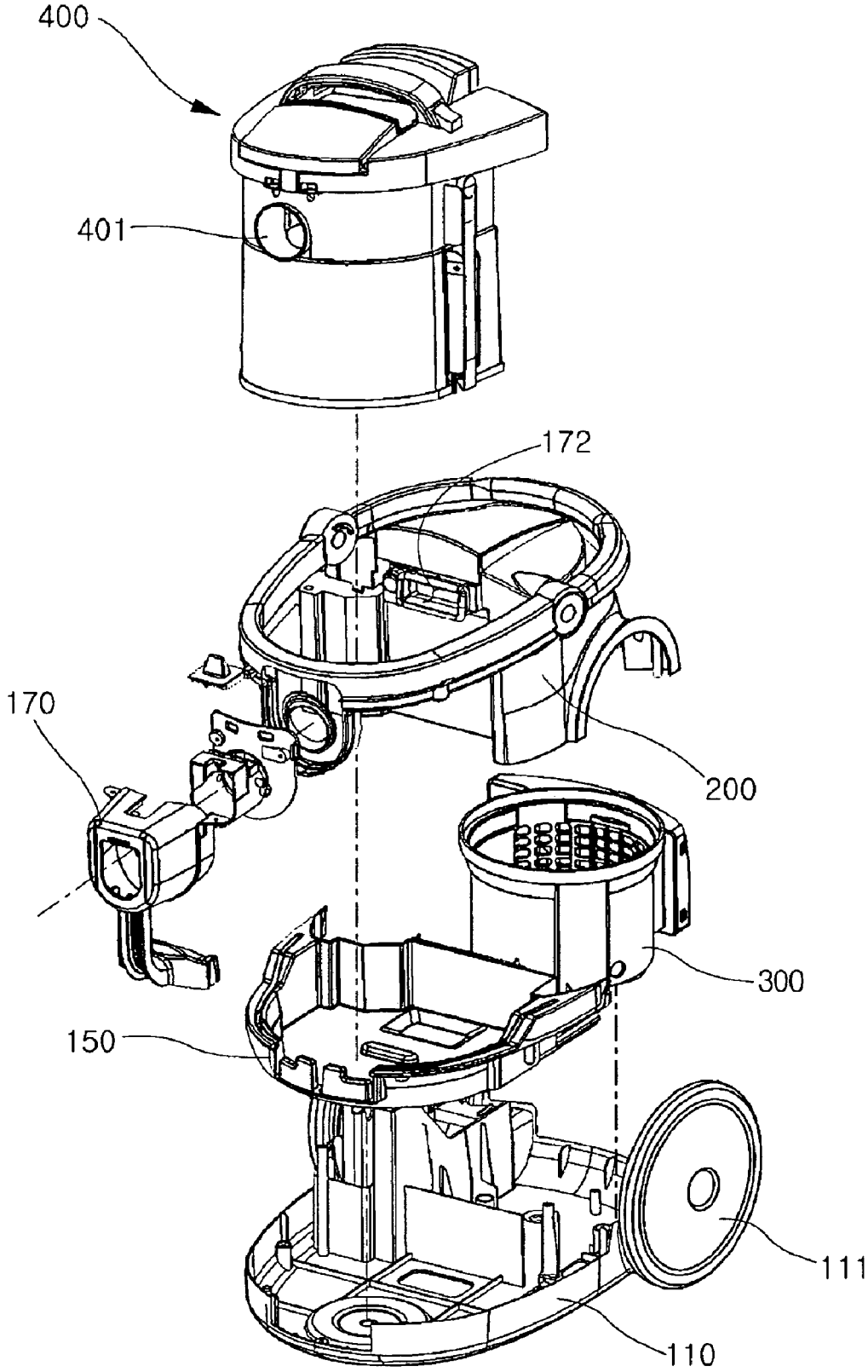
FIG. 4 is an exploded perspective view of a main body of a vacuum cleaner where a dust collection unit according to an embodiment of the present invention is employed.

FIG. 4 shows the main body of the vacuum cleaner.

Referring to FIG. 4, the second base 150 is disposed on a rear-top portion of the first base 110. A motor housing 300 is disposed on a rear portion of the first base 110. Then, the cover 200 is coupled to the first and second bases 110 and 150 to define the main body 100.

Here, the cover 200 is coupled to the first and second bases 110 and 150 in a state where the front support 170 is coupled to the cover 200. A flowing direction of the air introduced into the motor housing 300 through the third air intake hole 172 is changed by 90° in a vertical direction and is then changed in a horizontal direction so that the air can be exhausted rearward.

Figure 5:
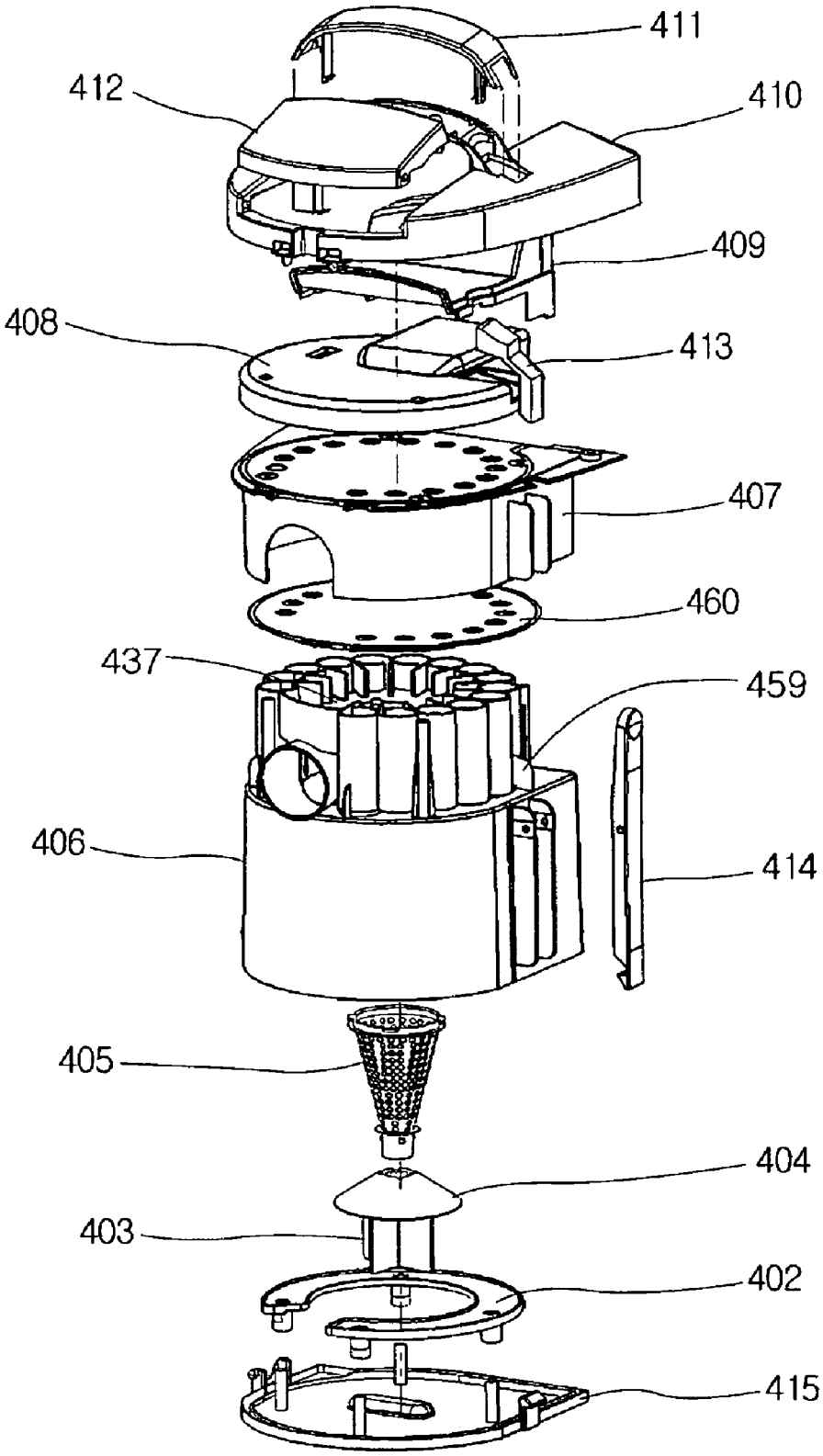
FIG. 5 is an exploded perspective view of a dust collection unit depicted in FIG. 4.

FIG. 5 shows the dust collection unit according to an embodiment of the present invention.

Referring to FIG. 5, the inventive dust collection unit 400 does not use a porous filter such as a sponge. That is, the inventive dust collection unit 400 is designed to filter the foreign objects using cyclone airflows. The cyclone airflow is generated at least two chambers separated from each other so that even the micro-scale dusts contained in the air can be filtered. This will be described in more detail hereinafter.

The dust collection unit 400 includes a collection body 406 provided with a plurality of filtering chambers (refer to the reference numerals 423 and 424 of FIG. 6) for filtering the foreign objects and a plurality of storing chambers (refer to the reference numerals 417 and 416 of FIG. 6) for storing the filtered foreign objects, chamber seal members 402 and 415 provided to seal a bottom of the collection body 406 and prevent the foreign objects stored in the storing chambers 416 and 417 from leaking, an air exhaust member 407 disposed on the collection body 406 to guide the flow of the air exhausted from the collection body 406, a gap forming member 408 providing a predetermined gap above the exhaust member 407 to allow the air exhausted from the exhaust member 407 to flow in a direction, and a cover assembly disposed on the gap forming member 408.

The cover assembly includes a first cover 410 functioning as a main body of the cover assembly, second and third covers 409 and 412 respectively disposed in rear and front of the first cover 410, a cover fixing member 411 fixing the first and second covers 410 and 409. The cover fixing member 411 is designed to cover a portion of the first cover 410 to improve the outer appearance while simultaneously fixing the first and second covers 410 and 409.

Disposed between the exhaust member 407 and the collection body 406 is a seal member 460 for tightly sealing a contacting surface between the exhaust member 407 and the collection body 406.

The exhaust member 407 is provided at an inner bottom surface with a seal groove 476 corresponding to tops of the second filtering chambers 424. The tops of the second filtering chambers 424 are received in the seal groove 476. At this point, the seal member 460 is interposed between the exhaust body 407 and the collection body 406 to tightly seal a contacting surface between the seal groove 476 and the tops of the second filtering chambers 424.

As described above, the seal groove 476 is formed to correspond to tops of the second filtering chambers 424. That is, the seal groove 476 is designed to have a shape identical to sections of the second filtering chambers 424 and second air introducing guides 422. Therefore, the seal groove 476 is formed in a closed-loop shape, as a result of which, no air leak is incurred from a space enclosed by the seal groove 476 to an outer side. Thus, the air containing the foreign objects exhausted through the separation plate 347 are leaked to the outer side but introduced into the second filtering chambers 424. In addition, No air/foreign object is exhausted from the second filtering chambers 424.

Since the seal member 460 is formed of a single part, there is no need to insert the seal member 460 for each second filtering chamber 424 in the production line. That is, the single seal member 460 is provided with a plurality of guide holes 477. Therefore, in a state where the guide holes 477 are inserted around air intake tube (refer to the reference numeral 425 of FIG. 6) extending downward from the inner bottom surface of the exhaust member 407, the exhaust member 407 is aligned with the collection body 406, thereby providing the assembling convenience to the worker.

Disposed in the dust collection body 406 are a cone-shaped filter 405 and a blocking member 404 and airflow preventing plates 403. The cone-shaped filter 405 is provided to effectively filter the foreign objects when the cyclone airflows are generated. The blocking member 404 is disposed under the cone-shaped filter 405 to prevent the collected foreign objects from flying. The airflow preventing plates 403 are formed under the blocking member 404 to lower the airflow rate and to thereby allow the foreign objects to sink to the bottoms of the foreign object storing chambers.

The airflow preventing plates 403 and the blocking member 404 may be integrally formed with each other while the cone-shaped filter 405 may be provided as a separated part that may be fitted on the cone-shaped filter 405. Therefore, when he foreign objects are clogged in the cone-shaped filter 405, after the blocking member 404 is separated from the cone-shaped filter 405, the foreign objects clogged in the cone-shaped filter 405 are conveniently removed from the cone-shaped filter 405.

Since the second air exhaust hole 401 is formed corresponding to an upper portion of the cone-shaped filter 405, a relatively high RPM cyclone airflow is generated at the upper portion of the cone-shaped filter 405 and a relatively low RPM cyclone airflow is generated at a lower portion of the cone-shaped filter 405. This is the reason for forming the filter 405 in the cone-shape. That is, since a large amount of the foreign objects are forced outward in the relatively high RPM cyclone airflow and a large amount of the foreign objects are forced in the relatively low RPM cyclone airflow, it is preferable that the filter 405 is formed in the cone-shape.

In addition, an opening/closing button 413 is provided on the first cover 410 and an opening/closing lever 414 having a first end contacting the opening/closing button 413 to pivot when the opening/closing button 413 is pushed. The opening/closing lever 414 has a second end contacting the first chamber seal member 415. Therefore, when the opening/closing lever 414 is pushed, the opening/closing lever 414 pivots around a predetermined hinge point. When the second end of the opening/closing lever 414 moves away from the first chamber seal member 415, the first chamber seal member 415 rotates around a hinge point by its self-gravity and the foreign objects collected in the storing chambers 416 and 417 settled by their self-gravities.

In addition, the chamber seal members 415 and 402 are designed to respectively seal the bottoms of the foreign object storing chambers 415 and 416. The first chamber seal member 415 is hinge-coupled to the collection body 406 so that it can be opened by a pivotal motion when it is intended to throw away the foreign objects stored in the first chamber seal member 415.

A separation plate 437 for separating the first and second filtering chambers 423 and 424 from each other and defining an air passage is provided on a top surface of the collection body 406.

A plurality of guide ribs 459 are formed on an outer circumference of the collection body 406 to guide the insertion of the exhaust member 407 around the collection body 406. Each of the guide ribs 459 are gently rounded at an upper corner to effectively guide the insertion.

Since outer ends of the guide ribs 459 are designed to contact an inner circumference of the exhaust member 407, even when outer impact is applied to the exhaust body 407, the outer impact can be absorbed by the guide ribs 459, thereby preventing the exhaust member 407 from being damaged or broken by the outer impact.

Figure 6:
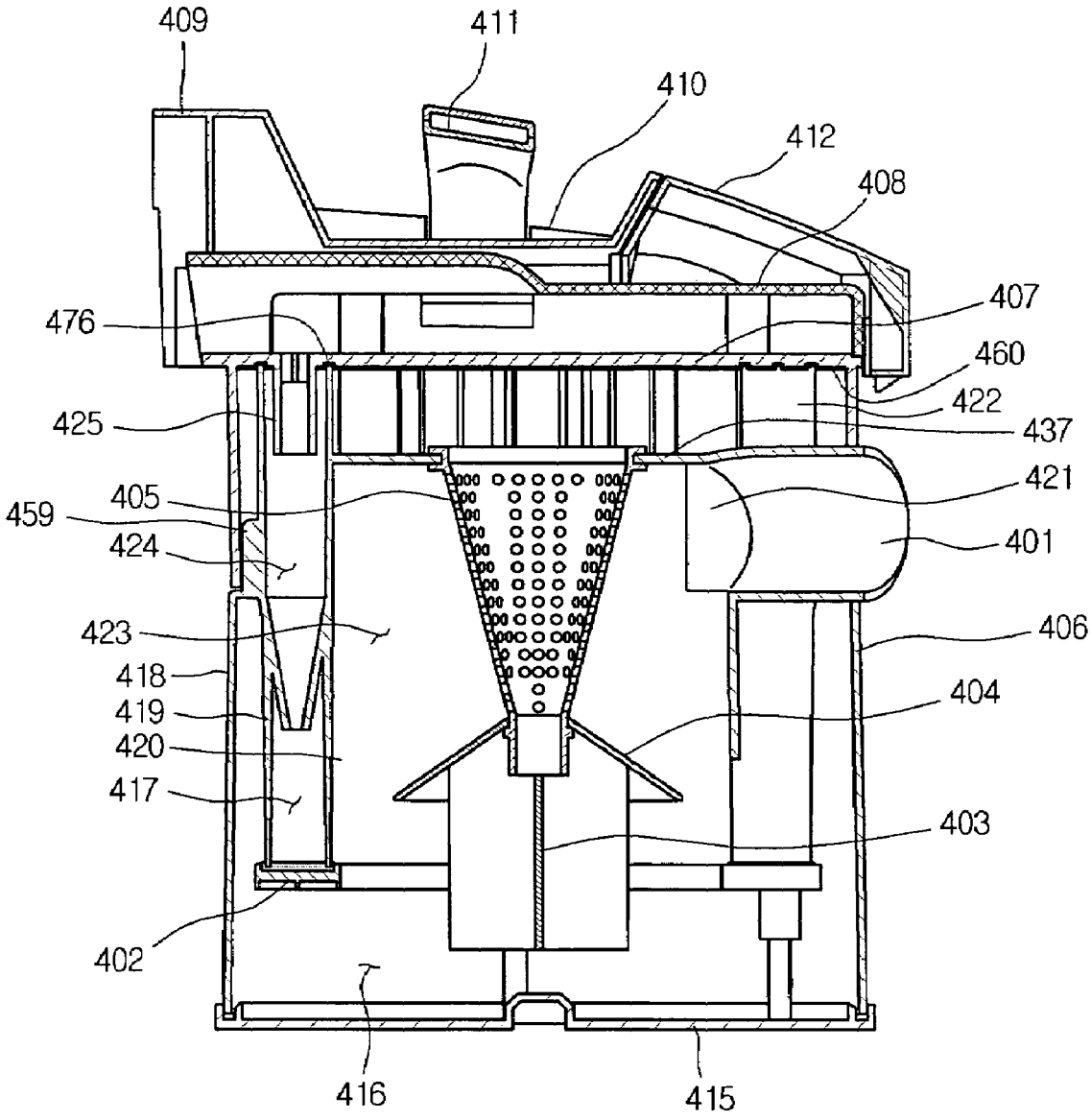
FIG. 6 is a sectional view taken along lines I-I' of FIG. 3.

The internal structure and operation of the dust collection unit 400 will be described in more detail with reference to FIG. 6.

The collection body 406 includes the outer wall 418, the intermediate wall 419 and the inner wall 420. The outer wall 418 and the intermediate wall 419 are not formed on the portion where the second air intake hole 401 is formed, thereby allowing the air to be effectively introduced.

A space defined between the outer wall 418 and the intermediate wall 419 becomes the first storing chamber 416 and a space defined between the intermediate wall 419 and the inner wall 420 becomes the second storing chamber 417. An inner space defined by the inner wall 420 becomes the first filtering chamber 423. However, the functions of the spaces vary according to the shape of the dust correction unit 400.

Meanwhile, the lower-inner circumference of the exhaust member 407 contacts the outer ends of the guide ribs 459. That is, since the exhaust member 407 is supported by the guide ribs 459, the strength of the exhaust member 407 increases against the outer impact. The guide ribs 459 will be described in more detail hereinafter.

The guide ribs 459 are formed extending outward from the outer circumference of the collection body 406. The lower-inner circumference of the exhaust member 407 contacts the outer ends of the guide ribs 459.

Preferably, the guide ribs 459 are integrally formed on the outer wall of the second filtering chambers 424 to be further increased in the strength. An upper end of each guide rib 459 are gently curved downward as it goes outward so as to guide the insertion of the exhaust member 407 around the dust body 406, thereby providing the assembling convenience to the worker.

The guide ribs 459 are formed to correspond to a plurality of locations on the inner circumference of the exhaust member 407. Therefore, even when the outer impact is locally applied to the exhaust member 407, the damage of the exhaust member 407 can be prevented, thereby increasing the endurance of the exhaust member 407. In addition, by providing the guide ribs in plurality, the assembling convenience may be further improved. When the guide ribs 424 are formed extending outward from the outer walls of the second filtering chambers 424, the manufacturing convenience and the strength may be further improved.

The operation of the above-described dust collection unit will be described hereinafter with reference to the airflow.

The air is first introduced into the dust collection unit 400 through the second air intake hole 401. Here, an outer end of the second air intake hole 401 communicates with the front support 170 and an inner end of the second air intake hole 401 communicates with the first filtering chamber 423. A first air introduction guide 421 is projected inward from a portion of the inner wall 420, which defines the inner end of the second air intake hole 401, to guide the air in an inner circumferential direction of the first filtering chamber 423.

The air introduced into the first filtering chamber 423 generates the cyclone airflow as it flows along the inner circumference of the first filtering chamber 423 by the first introduction guide 421. By the cyclone airflow, the foreign objects fall down and the cleaned air is exhausted through pores of the cone-shaped filter 405.

The air passed through the cone-shaped filter 405 is exhausted through a gap between the collection body 406 and the exhaust member 407 and is then directed into the second filtering chamber 424 through the second introduction guide 422. At this point, since no air leak is incurred through the contacting surface between the exhaust member 407 and the collection body 406, the dust collection efficiency of the dust collection unit 400 is improved. Particularly, since the seal groove 476 is formed on the inner bottom surface of the exhaust member 407 along a line which contacts the collection body 406, the air leak is further prevented.

After the micro-scale foreign objects contained in the air is filtered in the second filtering chambers 424, the further cleaned air is exhausted out of the dust collection unit 400. At this point, the air in the second filtering chambers 424 is not leaked by the association of the seal member 460 and the seal groove 476.

Another example of the seal member 460 provided on the airflow passage will be described hereinafter.

Figure 7:
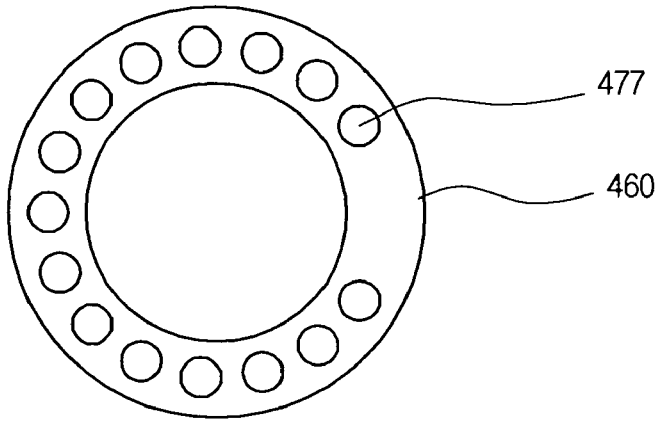
FIGS. 7 through 9 are plane views illustrating a variety of modified examples of a seal member of the present invention.

FIG. 7 shows a first modified example of a seal member according to the present invention.

A seal member 460 of this example is formed in a donut shape. In this case, the size of the seal member can be reduced and it is convenient to handle the same. Since the seal member 460 of this example is formed of a single part as in the forgoing example, the advantages obtained when it is formed of the single part can be identically provided.

In addition, when the seal member is formed in the donut shape, the air exhausted from the separation plate 437 does no come off the seal member, thereby preventing the seal member from being deformed or torn.

Figure 8:
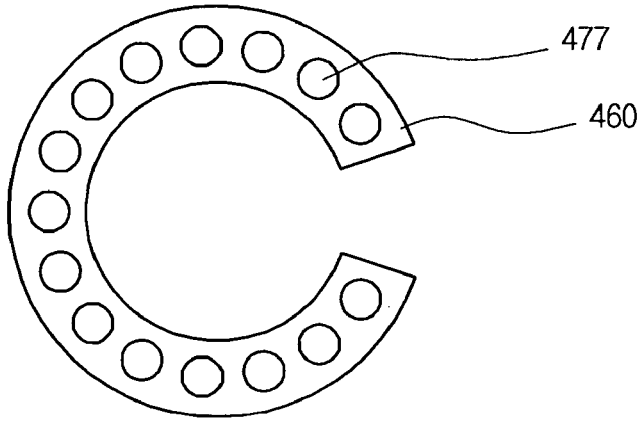

FIG. 8 shows a second modified example of the seal member.

A seal member 460 of this example is identical to that of the first modified example except that a portion corresponding the air intake hole 401 is eliminated from the donut-shaped seal member. In this case, the material cost can be further saved.

However, this structure is not preferable since the air exhausted from the separation plate 437 may possibly leak through the exhaust member 407. However, the air in the second filtering chamber 424 does not still leak, the seal effect for the dust collection unit 400 can be expected.

Figure 9:
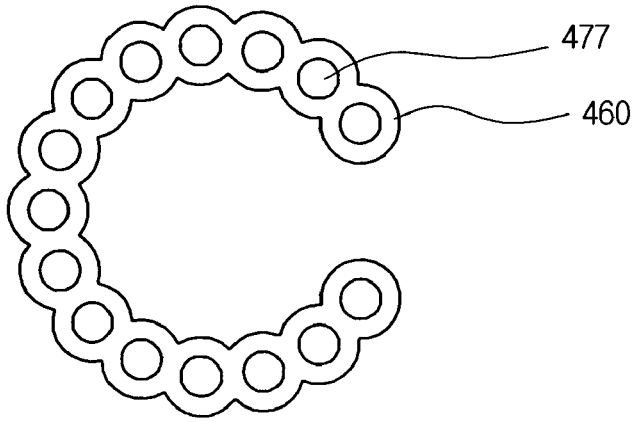

FIG. 9 shows a third modified example of the seal member.

A seal member 460 of this example is identical to that of the second modified example except that each surface contacting the second filtering chambers 424 are formed in a circular shape. In this case, the coming off phenomenon of the seal member 460 from the second filtering chambers 424 may be further prevented.

A feature of this example may be also applied to that of the first modified example.

The operation of the above-described dust collection unit 400 and the overall operation of the main body 100 of the vacuum cleaner will be described hereinafter with reference to FIG. 10.

Figure 10:
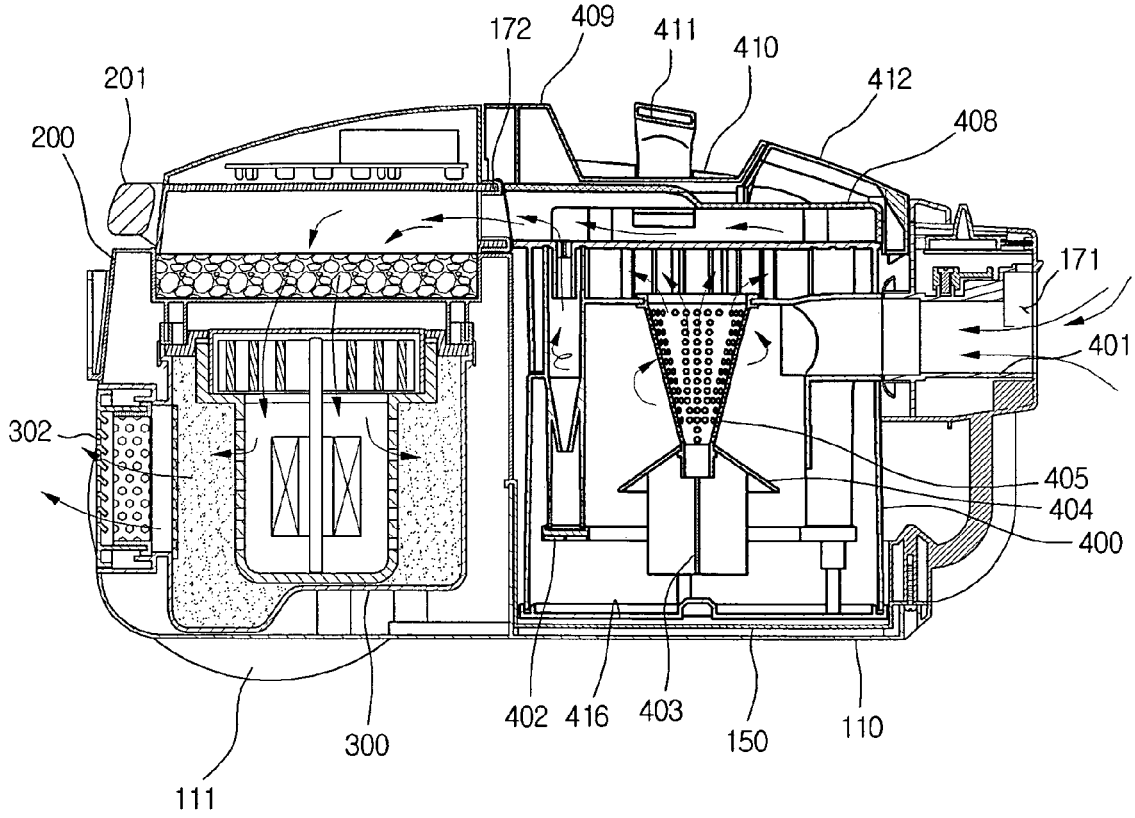
FIG. 10 is a longitudinal sectional view of a vacuum cleaner where a dust collection unit of the present invention is applied.

Referring to FIG. 10, outer air is introduced into the main body 100 through the air intake hole 171 of the main body 100 and is then introduced into the dust collection unit 400 through the air intake hole of the dust collection unit. The foreign objects contained in the air is filtered in the dust collection unit 400 as described above and is then introduced into the motor housing 300 in a horizontal direction.

The air introduced into the moor housing 300 in the horizontal direction moves downward to be exhausted through the exhaust holes 302 formed on the rear surface of the main body 100.

It will be apparent to those skilled in the art that various modifications and variations can be made in the present invention. Thus, it is intended that the present invention covers the modifications and variations of this invention provided they come within the scope of the appended claims and their equivalents.

For example, the application of the inventive dust collection unit is not limited to the air cleaner described in the embodiments. That is, the inventive dust collection unit may be applied to other types of air cleaners such as an upright type air cleaner.

According to the present invention, since no air leak is incurred in the airflow passage of the dust collection unit, the dust removal efficiency may further improved. In addition, since it is convenient to handle the seal member, the working efficiency may be improved.

In addition, when outer impact is applied to the exhaust member, the outer impact is absorbed by the guide ribs, thereby preventing the exhaust member from being damaged or broken and maintaining the initial shape of the dust collection unit. This may further enhance the prevention of the air leak.

What is claimed is:

1. A dust collection unit for a vacuum cleaner, comprising:

a collection body having a first central filtering chamber for filtering foreign objects contained in air using a cyclone airflow and a plurality of second filtering chambers formed along an outer circumference of the first cylindrical filtering chamber to receive the air passed through the first cylindrical filtering chamber;

an exhaust member having an upper end contacting the second filtering chambers and an inner circumference contacting an outer circumference of the collection body; and a seal member provided on a contacting surface between the second filtering chambers and the exhaust member, wherein the exhaust member includes air intake tubes and the seal member includes guide holes, and the guide holes are inserted around air intake tubes.

2. The dust collection unit according to claim 1, wherein the seal member is formed in a circular shape.

3. The dust collection unit according to claim 1, wherein the seal member is formed in a donut shape.

4. The dust collection unit according to claim 1, wherein the seal member is mounted on the collection body in a state where it is fixed on the exhaust member.

5. The dust collection unit according to claim 1, wherein the exhaust member is provided at an inner bottom surface with a seal groove having a shape identical to that defined by tops of the plurality of second filtering chambers.

6. The dust collection unit according to claim 1, further comprising a guide rib extending from an outer circumference of the collection body and contacting an inner circumference of the exhaust member.

7. The dust collection unit according to claim 6, wherein the guide rib is provided in plurality.

8. The dust collection unit according to claim 6, wherein an upper end of the guide rib is gently curved downward.

9. The dust collection unit according to claim 1, wherein the exhaust member contacts a guide rib extending from outer walls of the second filtering chambers.

10. The dust collection unit according to claim 1, wherein an air intake hole extends downward from the exhaust member and inserted into the second filtering chambers to exhaust the air out of the second filtering chambers.

11. A dust collection unit for an air cleaner, comprising:

a collection body provided with a plurality of foreign object filtering chambers;

an exhaust member provided on an upper portion of the collection body to guide the flow of the air exhausted from the foreign object filtering chambers; and a guide rib formed on an outer surface of the collection body to contact an inner circumference of the exhaust member.

12. The dust collection unit according to claim 11, further comprising a seal member inserted in a contacting surface between the exhaust member and the collection body.

13. The dust collection unit according to claim 11, wherein the guide rib is integrally formed with the collection body.

14. The dust collection unit according to claim 11, wherein the guide rib is provided in plurality on the outer surface of the collection body.

15. The dust collection unit according to claim 11, wherein the foreign object filtering chambers include:

a first filtering chamber formed on a center portion of the collection body; and a plurality of second filtering chambers formed around the first filtering chamber, a diameter of each second filtering chamber being less than that of the first filtering chamber.

16. The dust collection unit according to claim 11, wherein the exhaust member guides the air exhausted from the first filtering chamber to the second filtering chambers.

17. A dust collection unit for a vacuum cleaner, comprising:

a collection body defining a plurality of foreign object filtering chambers and foreign object storing chambers;

a filter disposed in one of the foreign object filtering chambers, the filter being formed of rigid plastic material;

an exhaust member provided above the collection body to guide the air exhausted from one of the foreign object filtering chambers;

a seal member inserted in a contacting surface between the exhaust member and the collection body;

a gap forming member provided above the exhaust member to provide a gap through which the air exhausted from the collection body is guided; and chamber seal members sealing a lower side of the foreign object storing chambers.

18. The dust collection unit according to claim 17, wherein the exhaust member is provided at an inner bottom surface with a seal groove enhancing the seal efficiency.

19. The dust collection unit according to claim 17, further comprising a guide rib extending outward from the collection body and contacting the exhaust member.

* * * * *